US008475015B2

(12) United States Patent
Liu et al.

(10) Patent No.: US 8,475,015 B2
(45) Date of Patent: Jul. 2, 2013

(54) LED LAMP HAVING LAMP HOLDER FIXED WITH HEAT SINK

(75) Inventors: Jun Liu, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 1004 days.

(21) Appl. No.: 12/399,029

(22) Filed: Mar. 6, 2009

(65) Prior Publication Data

US 2010/0052495 A1 Mar. 4, 2010

(30) Foreign Application Priority Data

Aug. 26, 2008 (CN) ..... 2008 1 0304204

(51) Int. Cl.
*F21V 19/00* (2006.01)
*F21V 29/00* (2006.01)

(52) U.S. Cl.
USPC ..... 362/373; 362/294; 362/547; 313/46

(58) Field of Classification Search
USPC ..... 313/44–47; 362/294, 373, 547
See application file for complete search history.

(56) References Cited

U.S. PATENT DOCUMENTS

| | | | | |
|---|---|---|---|---|
| 2,791,679 | A * | 5/1957 | Hierholzer, Jr. et al. | 362/645 |
| 4,607,192 | A * | 8/1986 | Billing et al. | 313/579 |
| 5,621,244 | A * | 4/1997 | Lin | 257/713 |
| 7,832,909 | B2 * | 11/2010 | Wang | 362/364 |
| 2007/0132092 | A1 * | 6/2007 | Hu et al. | 257/712 |
| 2007/0253202 | A1 * | 11/2007 | Wu et al. | 362/294 |
| 2008/0037255 | A1 * | 2/2008 | Wang | 362/294 |
| 2008/0158887 | A1 * | 7/2008 | Zhu et al. | 362/294 |

FOREIGN PATENT DOCUMENTS

| | | | |
|---|---|---|---|
| CN | 2481957 | Y | 3/2002 |
| CN | 101016983 | A | 8/2007 |
| CN | 200968549 | Y | 10/2007 |
| TW | M305873 | | 2/2007 |
| TW | 200809130 | A | 2/2008 |

* cited by examiner

*Primary Examiner* — Karabi Guharay
(74) *Attorney, Agent, or Firm* — Altis Law Group, Inc.

(57) ABSTRACT

An LED lamp includes a heat sink, an LED module received in the heat sink, a lamp holder disposed on a top end of the heat sink and covering the LED module, and a clip coupled to the lamp holder for securing the lamp holder to the heat sink. An annular fixing portion extends from a bottom of the lamp holder and surrounds a periphery of the top end of the heat sink. The clip hoops the fixing portion of the lamp holder and has a plurality of engaging portions extending through the fixing portion and inserted into the engaging slots of the heat sink correspondingly.

16 Claims, 3 Drawing Sheets

LED LAMP HAVING LAMP HOLDER FIXED WITH HEAT SINK

BACKGROUND OF THE INVENTION

1. Field of the Invention

The present invention relates to LED (light emitting diode) lamps and, more particularly, to an LED lamp incorporating a heat sink and a clip for readily securing the heat sink to the LED lamp.

2. Description of Related Art

As an energy-efficient light, an LED lamp has a trend of substituting for the fluorescent lamp for indoor or outdoor lighting purpose; in order to increase the overall lighting brightness, a plurality of LEDs are often incorporated into a signal lamp, in which how to efficiently dissipate heat generated by the plurality of LEDs becomes a challenge.

Conventionally, the LED lamp has a heat sink. An LED module including an LED or a plurality of LEDs on a printed circuit board is intimately mounted on the heat sink, so heat generated by the LED modules can be dissipated by the heat sink. In the conventional art, for a removal or reinstallment of the heat sink, multiple screws need to be loosened or fastened which makes operation of the removal or the reinstallment complicated and tedious.

What is needed, therefore, is an improved LED lamp which can overcome the described disadvantages.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION OF THE INVENTION

Figure 1:
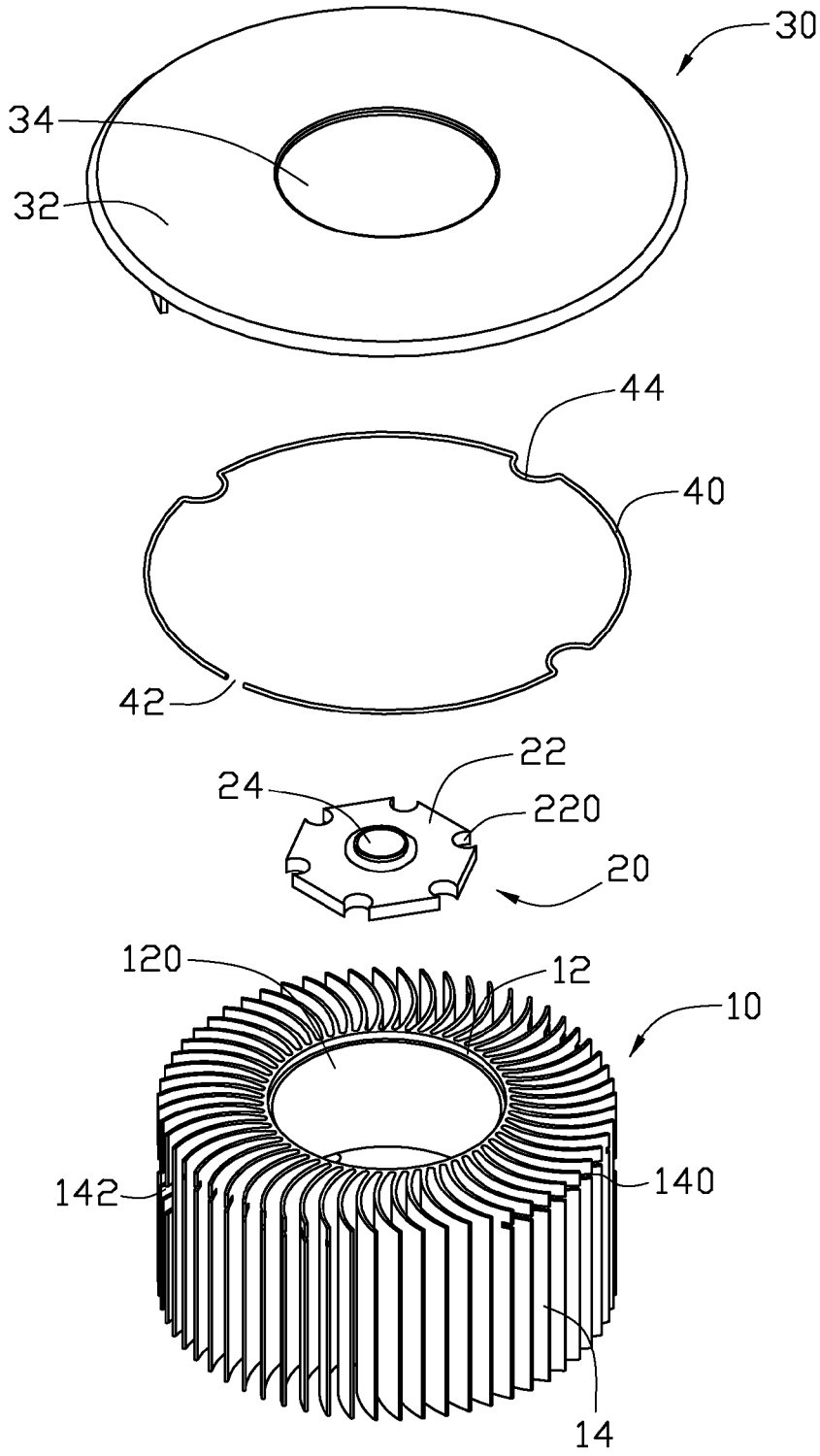
FIG. 1 is an isometric, exploded view of an LED lamp in accordance with an embodiment of the disclosure.

Referring to FIG. 1, an LED lamp in accordance with an embodiment is illustrated. The LED lamp comprises a heat sink 10, an LED module 20 received in the heat sink 10, a lamp holder 30 disposed on the heat sink 10 and covering the LED module 20, and a clip 40 securing the lamp holder 30 to the heat sink 10.

Figure 2:
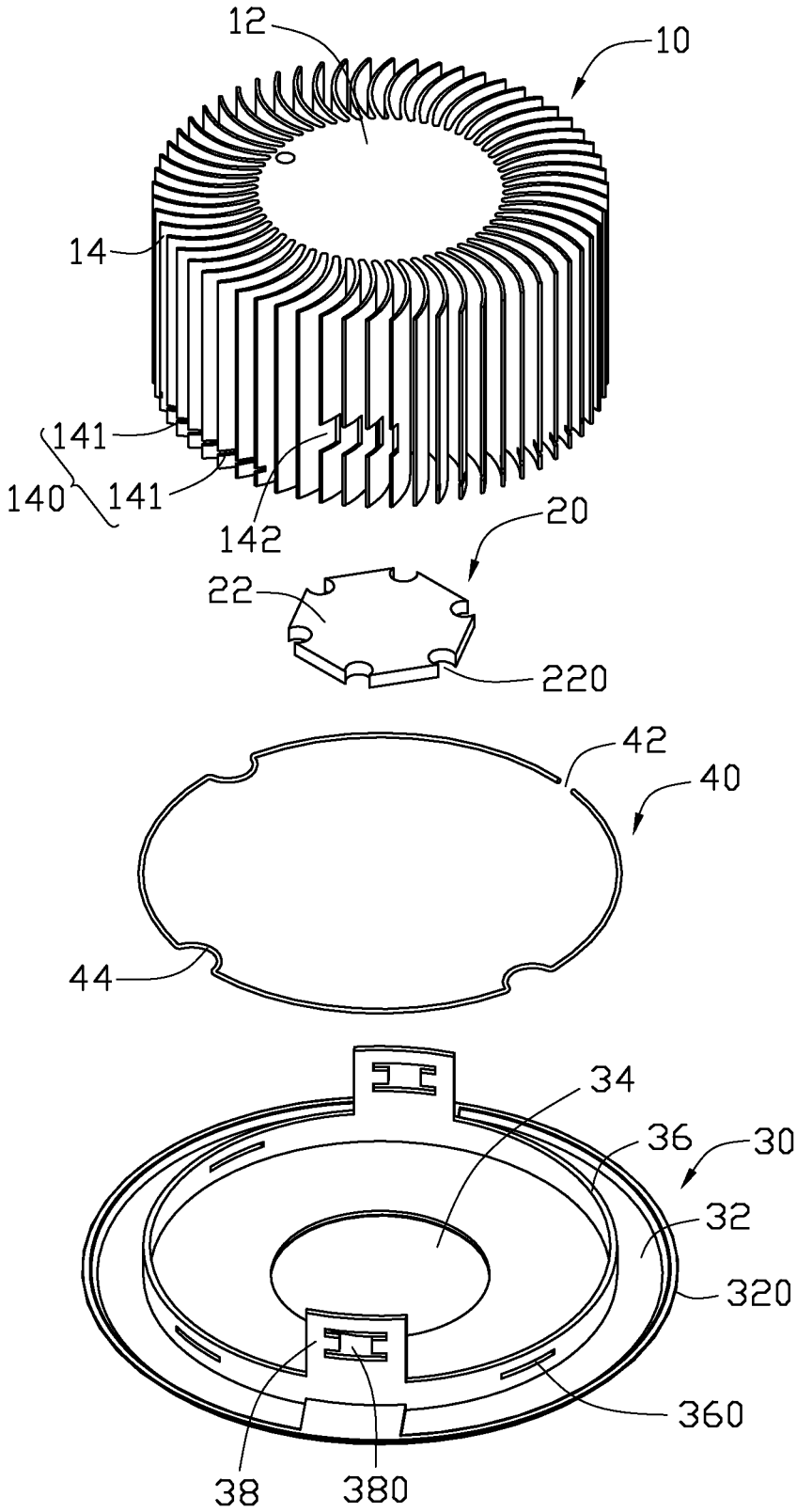
FIG. 2 is an inverted view of the LED lamp in FIG. 1.

Also referring to FIG. 2, the heat sink 10 has a cylindrical configuration and is made of a metal with high heat conductivity, such as copper, aluminum, or an alloy thereof. The heat sink 10 comprises a central body 12 and a plurality of curved fins 14 extending outwardly and radially from an outer circumference of the central body 12. Each fin 14 has a height substantially the same as a height of the central body 12. An upper portion of the central body 12 is a tubular, which defines a cylindrical receiving room 120 therein. Three elongated engaging slots 140 are defined at an outer circumference of the fins 14 along a circumference of the heat sink 10. Each of the engaging slots 140 consists of a plurality of cutouts 141 communicated with each other. Each of the cutouts 141 is correspondingly defined in an outer lateral end of a corresponding fin 14. The three engaging slots 140 are spaced from and on a same level with each other. The engaging slots 140 are located close to a top end of the heat sink 10. Two grooves 142 are defined at the outer circumference of the fins 14 along the circumference of the heat sink 10. The two grooves 142 are located lower than the engaging slots 140 and respectively at two opposite lateral sides of the heat sink 10.

The LED module 20 comprises a printed circuit board 22 having a floral shape, and an LED 24 mounted on a center of the printed circuit board 22. A plurality of recesses 220 are evenly defined in an edge of the printed circuit board 22. The LED module 20 is fixed on a bottom of the receiving room 120 of the heat sink 10 to thermally contact the central body 12 by a plurality of screws (not shown) extending through the recesses 220 and threadedly engaging in the central body 12, respectively. Alternatively, the LED module 20 can be fixed in position by using thermally conductive adhesive. When the LED 24 is activated to lighten, heat generated by the LED 24 is conducted to the central body 12 via the printed circuit board 22, and then transferred to the fins 14 of the heat sink 10.

The lamp holder 30 is round-shaped and horizontally coupled to a top of the heat sink 10. The lamp holder 30 comprises an annular and planar frame 32 and a circular lens 34 is correspondingly located at a center of the frame 32. An annular fixing portion 36 extends downwardly and perpendicularly from a bottom surface of the frame 32 and surrounds the lens 34. An inner diameter of the fixing portion 36 is equal to or slightly larger than an outer diameter of the heat sink 10. Three elongated through holes 360 are defined in the fixing portion 36 and along a circumference of the fixing portion 36. The three through holes 360 are spaced from and on a same level with each other. Two opposite mounting ears 38 protrude downwardly from a bottom edge of the fixing portion 36 for mounting the LED lamp to a supporting structure (not shown). A horizontally oriented H-shaped engaging hole 380 is defined in each of the two mounting ears 38. When the lamp holder 30 is fixed to the heat sink 10, the lens 34 is positioned above the receiving room 120 of the heat sink 10 for covering the LED module 20 received therein. The lens 34 is made of transparent material such as plastic, glass or other suitable material availing to transmit light from the LED module 20. An annular flange 320 extends downwardly from an outer circumference of the frame 32.

Figure 3:
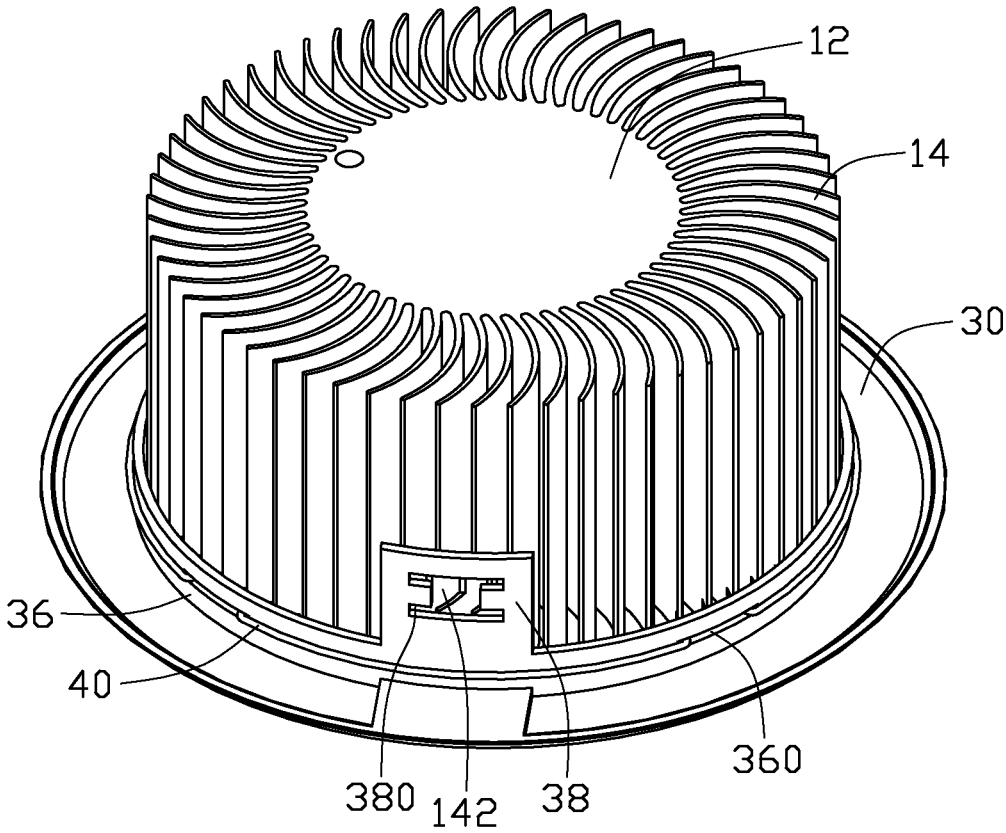
FIG. 3 is an inverted, assembled view of the LED lamp in FIG. 1.

Also referring to FIG. 3, the clip 40 is a wire clip integrally made of a resilient metal wire. The clip 40 is integrally ring-shaped with a break opening 42. The clip 40 has three spaced engaging portions 44 bended inwardly and horizontally towards a center of the clip 40. The engaging portions 44 each are arc-like shaped. A diameter of the clip 40 is equal to or slightly less than an outer diameter of the fixing portion 36 of the lamp holder 30.

In assembly of the LED lamp, the LED module 20 is accommodated in the receiving room 120 of the heat sink 10 and secured to the heat sink 10. The lamp holder 30 is disposed on the top of the heat sink 10. An inner periphery of the fixing portion 36 surrounds a periphery of the top of the heat sink 10. The clip 40 hoops an outer periphery of the fixing portion 36. The three through holes 360 of the fixing portion 36 are in alignment with the three engaging slots 140 of the heat sink 10 respectively, whereby the three engaging portions 44 of the clip 40 extend through the three through holes 360 and are inserted into the three engaging slots 140 correspondingly. Thus, the heat sink 10 is reliably secured to the lamp holder 30. The two engaging holes 380 are in alignment with the two grooves 142 of the heat sink 10, respectively. Two mounting members (not shown) of the supporting structure (not shown) extend through the two engaging holes 380 and are inserted into the two grooves 142 correspondingly for mounting the LED lamp to the supporting structure. To release the heat sink 10 from the lamp holder 30, the clip 40 is pulled outwards from the fixing portion 36 to enlarge the break opening 42, thereby expanding the clip 40 outwardly until the engaging portions 44 disengage from the engaging slots 140 of the heat sink 10. Thus, the heat sink 10 can be easily removed. Also, reinstallment of the heat sink 10 to the lamp holder 30 can be easily achieved by first expanding and then releasing the clip 40 to cause the engaging portions 44 of the clip 40 to insert into the engaging slots 140 of the heat sink 10.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a heat sink defining a receiving room in an end thereof, a plurality of elongated engaging slots are defined in an outer circumference of the heat sink;

an LED module fixed on a bottom of the receiving room and thermally connecting with the heat sink;

a lamp holder fixed on the end of the heat sink, having an annular fixing portion extending from a bottom of the lamp holder and surrounding the outer circumference of the heat sink near the end of the heat sink, wherein a plurality of elongated through holes are defined in the fixing portion and along a circumference of the fixing portion, the elongated through holes located corresponding to the engaging slots of the heat sink; and a clip coupled to the fixing portion of the lamp holder and having a plurality of engaging portions extending through the elongated through holes in the fixing portion and being correspondingly inserted into the engaging slots of the heat sink.

2. The LED lamp as claimed in claim 1, wherein the heat sink comprises a central body and a plurality of fins extending outwardly from an outer circumference of the central body.

3. The LED lamp as claimed in claim 2, wherein the engaging slots are defined at an outer circumference of the fins along a circumference of the heat sink, the engaging slots are spaced from each other.

4. The LED lamp as claimed in claim 3, wherein the engaging slots of the heat sink are on a same level with each other.

5. The LED lamp as claimed in claim 3, wherein each of the engaging slots consists of a plurality of cutouts communicated with each other, each of the cutouts is correspondingly defined in an outer lateral end of a corresponding fin.

6. The LED lamp as claimed in claim 1, wherein the lamp holder comprises an annular frame and a lens located at a center of the frame.

7. The LED lamp as claimed in claim 6, wherein the fixing portion extends downwardly from a bottom surface of the frame and surrounds the lens.

8. The LED lamp as claimed in claim 1, wherein the engaging portions of the clip secure the lamp holder and the heat sink together.

9. The LED lamp as claimed in claim 1, wherein the clip is integrally ring-shaped with a break opening and hoops an outer circumference of the fixing portion.

10. The LED lamp as claimed in claim 9, wherein a diameter of the clip is equal to or slightly less than an outer diameter of the fixing portion of the lamp holder.

11. The LED lamp as claimed in claim 1, wherein each of the engaging portions of the clip is arc-shaped.

12. An LED lamp comprising:

a heat sink comprising a central body and a plurality of fins extending outwardly from an outer circumference of the central body, a receiving room recessed in a top end of the central body, a plurality of engaging slots defined in an outer circumference of the fins at intervals;

an LED module received in the receiving room and thermally connecting with the heat sink;

a lamp holder disposed on a top end of the heat sink and comprising an annular frame and a lens positioned above the LED module, an annular fixing portion extending downwardly from a bottom of the annular frame and abutting against the outer circumference of the fins near the top end of the heat sink, wherein the fixing portion has a radius smaller than that of the frame; and a ring-shaped wire clip hooping the fixing portion of the lamp holder and having a plurality of engaging portions protruding inwardly, the engaging portions extending through the fixing portion of the lamp holder and inserted into the engaging slots of the fins of the heat sink, respectively, to thereby secure the heat sink to the lamp holder.

13. The LED lamp as claimed in claim 12, wherein the central body has a cylindrical configuration and the fins have a height the same as that of the central body.

14. The LED lamp as claimed in claim 13, wherein the engaging slots are spaced from and on a same level with each other, the fixing portion defining through holes therein for extension of the engaging portions of the wire clip therethrough to engage in the engaging slots, the through holes being located corresponding to the engaging slots.

15. The LED lamp as claimed in claim 12, wherein the engaging portions of the clip protrude towards a center of the clip.

16. The LED lamp as claimed in claim 12, wherein the clip has a break opening.

* * * * *